United States Patent [19]

Giori

[11] 3,939,621

[45] Feb. 24, 1976

[54] PROCESSING OF SHEETS OF PRINTED SECURITY PAPERS INTO BUNDLES AND PACKETS

[75] Inventor: Gualtiero Giori, Lonay, Switzerland

[73] Assignee: De La Rue Giori S.A., Switzerland

[22] Filed: Mar. 17, 1975

[21] Appl. No.: 559,236

[30] Foreign Application Priority Data

Mar. 26, 1974 Switzerland ..... 4183/74

[52] U.S. Cl. ..... 53/23; 53/26; 53/32; 53/54; 53/123; 53/159; 53/184 R; 53/198 R

[51] Int. Cl.[2] ..... B65B 63/00; B65B 57/14

[58] Field of Search ..... 53/23, 26, 30, 32, 54, 53/123, 159, 184, 198

[56] References Cited

UNITED STATES PATENTS 2,917,884 12/1959 Winkler et al. ..... 53/54 X 3,628,309 12/1971 Seragnoli ..... 53/54 X

*Primary Examiner*—Travis S. McGehee
*Assistant Examiner*—John Sipos
*Attorney, Agent, or Firm*—Robert E. Burns; Emmanuel J. Lobato; Bruce L. Adams

[57] ABSTRACT

Piles of sheets printed with numbered banknotes are cut into bundles, and the bundles are stacked in magazines of a rotary-drum bundle collector to form packets in which the notes are sequentially numbered, these packets being wrapped and then arranged in a serial ordinator. During delivery to the collector, bundles containing previously marked spoil notes are detected and deviated. The spoil notes are replaced at a substitution station and the bundles remade. Dummy bundles are inserted in gaps left in the delivery line, so as to maintain the correct sequence in the collector, and are removed at the collector output and replaced by the respective remade bundles.

20 Claims, 7 Drawing Figures

PROCESSING OF SHEETS OF PRINTED SECURITY PAPERS INTO BUNDLES AND PACKETS

The invention relates to the processing of piles each formed of a constant number of sheets each printed with N numbered security papers such as banknotes, in which the numbering of the security papers at like positions of the successive sheets of each pile and of the successive piles is in an uninterrupted sequence, and on which sheets some of the security papers may bear control marks recording imperfections, into bundles of security papers each having said constant number of security papers in sequential order and arranged in packets of sequentially numbered bundles in which said imperfect security papers are replaced by perfect ones.

Freshly printed sheets banknotes and similar security papers are manually visually controlled for the presence of printing errors or dirt marks, each imperfect banknote being marked for example by means of a special graphite pencil to enable the detection and removal of the imperfect banknote at a later stage. The visually controlled sheets of banknotes, possibly bearing some of these special marks, must then be cut into individual banknotes. This cutting is carried out with piles of sheets to form bundles of stacked banknotes, and by appropriately numbering the sheets each bundle is arranged to have successively numbered banknotes; adjacent bundles of each pile do not follow in numerical sequence, but the bundles each cut from a given position on the successive piles of sheets follow on. Consequently, the bundles, which are usually banded, of the successively cut piles of sheets must be sorted into packets wherein the banknotes, arranged in bundles, are sequentially numbered according to a given serial.

For example, a numbering machine may deliver piles each of one hundred sheets which are cut into bundles each of one hundred banknotes which, after banding, are arranged in packets of ten bundles each having one thousand sequentially numbered banknotes. When for example the number of serials per sheet is twenty-four (i.e. there are 24 banknotes per sheet, arranged for example in six rows of four columns), the arrangement into packets of ten bundles requires piling of the first, 25th, 49th . . . etc . . . bundles; the second, 26th, 50th . . . etc . . . bundles; and so on, to ensure that each packet has one thousand banknotes numbered in perfect sequence and each belonging to a given series of a thousand banknotes.

For example, all of the banknotes on a sheet may have the same numbering in the final three digits of the number whereas the various banknotes on a sheet may be differentiated by their different serial designations, for example by providing differently numbered tens of thousands, or even higher numerotations.

In automated or semi-automated lines for processing such freshly printed and numbered sheets of banknotes, there is thus a problem of automatically providing the required sorting of the cut and banded bundles while ensuring that any imperfect bank-notes in the bundles are replaced by perfect and numbered banknotes, without disturbing the automation of said sorting and the formation of packets.

The invention therefore provides an installation for processing piles of numbered sheets into packets of bundles as set out above, comprising:

means for receiving a pile of sheets and cutting the pile into N bundles of security papers;

means for conveying the bundles of each successively cut pile in a given order along a first path;

a detector for detecting the presence in a bundle along said first path of at least one marked imperfect security paper;

means responsive to said detector for deviating from said first path said bundles including imperfect security papers;

means for placing dummy bundles each in the place in said first path formerly occupied by a deviated bundle;

a bundle collecting device including N individual magazines for receiving respective ones of the N bundles formed from each pile of sheets, and the respective dummy bundles, at the end of said first path to form N packets of a given number of bundles from a given number of piles;

means for conveying the packets of bundles from said collecting device along a second path to a packet wrapping device;

a substitution station for receiving said deviated bundles and treating them to remove imperfect security papers and replace them by perfect numbered security papers, and reform the bundle in the correct order;

and at least one bundle replacement station located before said packet wrapping device where said dummy bundles are removed from the at least partly formed packets and replaced by the respective reformed bundles delivered by said substitution station.

By means of this installation, in each of the magazines of the collecting device there are thus formed packets of bundles in the correct numerical sequence, and the time taken for passage of the bundles through the collecting device is employed to substitute, with perfect banknotes, any imperfect banknotes (or other security papers) in the bundles which are deviated from the normal conveying line before delivery to the collecting device. The reformed bundles are then only reintroduced into the normal conveying line during formation of the packets in the collecting device, or downstrean of the collecting device after formation of the packets. The substitution of dummy bundles in the places left vacant by the deviated bundles enables automated sorting to be carried out in the bundle collecting device without interruption and without disruption of the correct sequence. The collecting device advantageously consists of two like drums each having N magazines at its periphery, one of the drums being loaded during a slow rotation thereof until all of its magazines are filled, whereas during the same time the other previously-loaded magazine is rotated step-by-step and is unloaded by expulsion of the packets of bundles from the magazines to, for example, a conveyor belt moving them along the second path.

The invention also concerns a method of processing piles of sheets printed with security paper into packets of bundles.

The invention will now be described in detail, by way of example, with reference to the accompanying drawings, in which.

Figure 1:
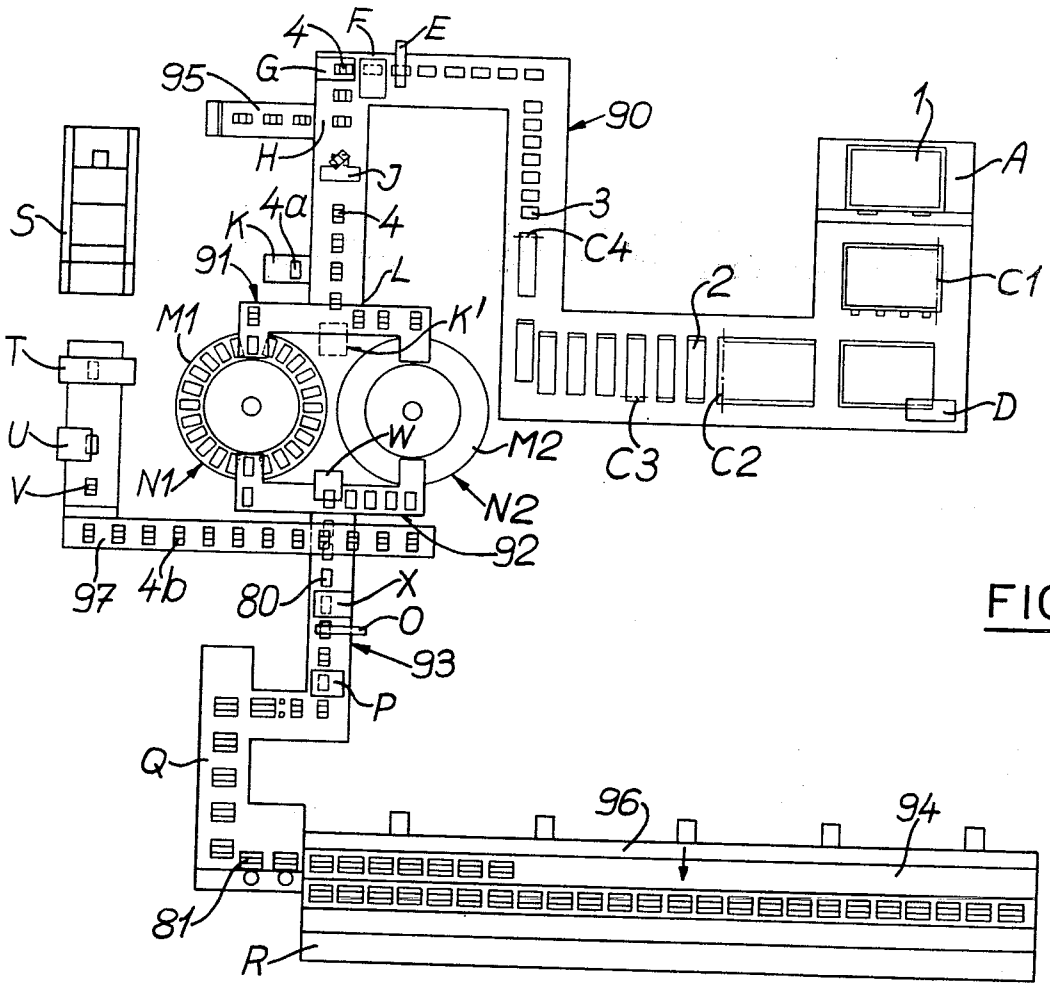
FIG. 1 is a schematic overall plan view of an installation according to the invention.

The installation of FIG. 1 is for the processing of sheets already printed with numbered banknotes, which are supplied to an input A of a cutting machine, in piles 1 each of 100 sheets. In the example considered, each sheet carries 24 printed banknotes arranged in four columns and six rows. The banknotes in a pile 1 of sheets each belong to a determined serial and are sequentially numbered within this serial. During a preliminary inspection of the sheets, defective or maculated banknotes are marked by means such that when bundles of the banknotes later pass a detector G, the detector responds to these marks.

The piles 1 of sheets are delivered to a first cutting unit C1 where the left-hand edges, looking in the direction of feed, of the piles are trimmed. Next, the piles 1 are delivered to an angular counting station D, where the number of sheets is automatically counted to check that each pile 1 contains one hundred sheets. After a change in their direction of feed by 90°, the piles 1 are delivered to a second cutting unit C2 which, after trimming the leading edge of each pile 1, cuts the pile of sheets into four strips 2 each of width corresponding to the length of a banknote, each strip in the pile having six banknotes in a row. At a third cutting unit C3, the left hand edges of the piled strips 2, looking in the direction of feed, are trimmed. After a further change of 90° in the direction of feed, the strips 2 are delivered to a fourth cutting unit C4 where the forward edge of each pile of strips 2 is firstly trimmed, and then the strips are cut into bundles 3 each containing one hundred cut banknotes.

After leaving cutting unit C4, the separate bundles 3 continue along conveyor path 90 where, after a change of direction of 90°, they are each banded in a banding unit E, and the bands imprinted in a printing unit F.

The banded bundles 4 pass by a detector G which scans them and detects the presence of one or several marked spoil notes in any bundle 4 and emits a corresponding actuating signal to a mechanical deviating device H where the bundles 4, after a further change of 90° in the feed direction, pass after a given time interval. The device H diverts every bundle 4 with one or more spoil notes onto a special conveyor belt 95. The detector G may for example be a capacitative or inductive detector reacting to the dielectric or inductive properties of the marking substance applied to the spoil notes. However, it is possible to use detectors reacting to different criteria of appropriate marking substances.

In the following description, it is firstly supposed that there are no bundles with spoil notes, and consequently no interruption in the succession of bundles. At a station J, the successive bundles are alternately turned by 90° to the right and to the left; this ensures that intaglio printed notes, or notes which contain a watermark, for example, will not be detrimental to uniformity of the heights of the packets formed later on.

The bundles 4 are then fed from conveyor path 90, by means of a distribution head L and two conveyors 91, which will be described later with reference to FIGS. 2 and 3, to a collection device formed of two like bundle collecting drums M1, M2, which will be described later with reference to FIGS. 4 and 6. The bundles 4 are supplied by distribution head L, so that when one of the bundle drums is filled, the following bundles are switched without interruption to the other drum until this is filled in turn, and so on. In this way, the filled drum can discharge while the other is being filled. Each drum has, uniformly spaced about its periphery, as many banknote magazines as there are printed banknotes per sheet, i.e. twenty four magazines in the example under consideration. The 24 bundles 4 from one and the same pile 1 of sheets are thus placed in respective successive ones of the twenty four magazines of one of the drums. Each drum rotates so that the bundles 4, from successive pile 1 of sheets, and which correspond to a given banknote position on the sheets, are all stacked in one given magazine of a drum. For example, in each magazine 10 bundles 4 of banknotes are stacked to form a packet in which the notes all originate from a given position on the 10 successive piles of sheets, and hence have the same serial number. Since in the numbering machine, the same positions of successive sheets are numbered consecutively, the banknotes of all the bundles and packets of bundles are numbered sequentially.

After filling all the magazines of one drum, these packets 80 of notes are discharged one-by-one from each magazine onto a conveyor belt 92 which delivers them onto a further conveyor belt 93. A counter W at the point of convergence of belts 92 and 93 effects a count to ensure that each packet 80 contains a thousand notes. The packets 80, each formed of ten bundles of a hundred banknotes, are then banded at a banding station O and the packet bands are imprinted by a printer P. The banded packets are then tumbled from their upstanding position to lay flat and are each wrapped in a sheet of heat-shrinkable plastics material at a station Q, then passed through a shrink tunnel where the wrap sheets are heat shrunk to tightly enclose all faces of the packets. The wrapped packets 81 are then fed one-by-one onto a conveyor belt 94 of a serial ordinator R, this belt having a capacity corresponding to the number of serials (notes) contained in the printed sheets; for example, it is able to receive 24 packets. When the entire length of belt 94 is fully loaded with packets, the entire row of packets is automatically discharged sideways, as indicated by the arrow, by a register bar 96. By means of adjustable transverse guide rails, these rows of packets are separated so that the transverse columns of packets of the same serial are clearly separated from the adjacent columns of packets of other serials, thus ensuring that all the packets belonging to the same serial are always automatically discharged in the same column. The individual packets then slide by their own weight down a slope towards a delivery where they may be directly packed into boxes.

The described installation hence enables automatic processing of the sheets leaving the numbering device up to wrapping of packets each containing, in the given example, a thousand banknotes in number and serial sequence, formed as 10 bundles each of 100 banknotes, and arrangement of the wrapped packets whereby packets of the same serial are clearly separated from packet of another serial.

In the following example, we will consider the case in which there is at least one spoil note on a sheet, and a bundle 4 containing one or more spoil notes is detected by detector G, the position of the spoil note(s) in the bundle being of no importance. This bundle 4 is diverted from the normal conveyor line by deviating device H onto conveyor belt 95 which delivers it towards a semi-automatic substitution station S. After removal of the band, the hundred banknotes of the bundle are automatically passed one-by-one under a detector which scans them and identifies each spoil note, which is replaced by a perfect note from a separate magazine, and the bundle is remade with the banknotes in the same correct sequence. Each replacement note thus occupies the place left vacant in the bundle by the removed spoil note. The replacement note may come from a "star" series, or is printed with the appropriate number by a small numbering machine, so that the reformed bundle has the correct numerical sequence.

For the purpose of control, the removed spoil notes and the inserted replacement notes are counted and recorded, preferably automatically. When the replacement notes bear the numbers of a special star series, a printed control sheet is provided for each reformed 100-note bundle to record the number of replacement notes in the bundle as well as the serial number of the replacement notes and of the removed spoil notes.

The reformed bundles leaving substitution station S are rebanded in a banding machine T, for example using pre-printed bands, then controlled by a detector U, similar to detector G, to ensure that all of the spoil notes have been replaced, and in a note counter V which checks whether the bundles are complete. The controlled, reformed bundles **4*b* are then delivered by a conveyor belt 97, which passes over belt 93 in the proximity of the output of drums M1, M2 where two operators at stations N1 and N2 take the reformed bundles 4*b* from belt 97 and insert them manually into their respective position — the identification of which will be explained further on — in the packets of bundles. This insertion may advantageously take place in the individual magazines of drums M1 and M2 during formation of the packets of bundles, where the reformed bundles 4*b*** are simply inserted at the top of the packet being formed.

During substitution of the spoil notes by perfect ones at substitution station S, and the subsequent reforming and control operations, the processing of bundles containing no spoil notes continues without interruption on the main conveyor path between device H and the drums M1, M2. To achieve this, and to enable replacement of the reformed bundles in the correct position, each gap in the line of bundles along the conveyor path created by the diversion of a bundle 4 containing one or more spoil notes is automatically filled by the insertion of a dummy bundle **4*a* formed by a block having the same size as the regular 100-note bundles. Introduction of the dummy bundles 4*a* for example takes place at a replacement station K, situated before the distribution head L, and controlled by detector G. By the insertion of these dummy bundles, the correct sequence of introduction of the bundles in the magazines of drums M1, M2 is maintained without perturbation. Alternatively, this replacement station could be formed by a magazine K′ disposed centrally above the distribution head L, where the dummy bundles are allowed to drop into the gaps. The dummy bundles preferably have a distinctive colour and are sequentially numbered on a face which will remain visible in a formed packet, which enables them to be extracted from the packets being formed in the magazines of drums M1, M2 and replaced by the corresponding remade bundles 4*b* whose places they had occupied. This substitution is for example manually carried out by operators at stations N1, N2. At the delivery of drums M1, M2, counter W controls whether all of the packets are complete. A supplementary detector X, similar to detector G is placed along an initial section of belt 93,** before banding station O, to detect and signal the presence of a dummy bundle which may inadvertently have been left in a packet.

Supposing that at a normal operating speed 24 100-note bundles (i.e. 2400 banknotes) are treated per minute, the time required to fill or empty one of drums M1, M2 with a total of 240 bundles take about 10 minutes, so that about 10 minutes are available for the substitution of spoil notes, and reforming and controlling the bundles diverted by device H before reintegrating them in the main flow line. This time interval is in general sufficient for the described substitution. If it becomes necessary to remove and replace a high number of spoil notes in a short time, the speed of operation of the installation could if necessary be momentaneously slowed, or it would be possible to provide a second substitution station in parallel.

Alternatively, replacement of the reformed bundles could be carried out on belt 92 before passage by the counter W and detector X.

Figure 2:
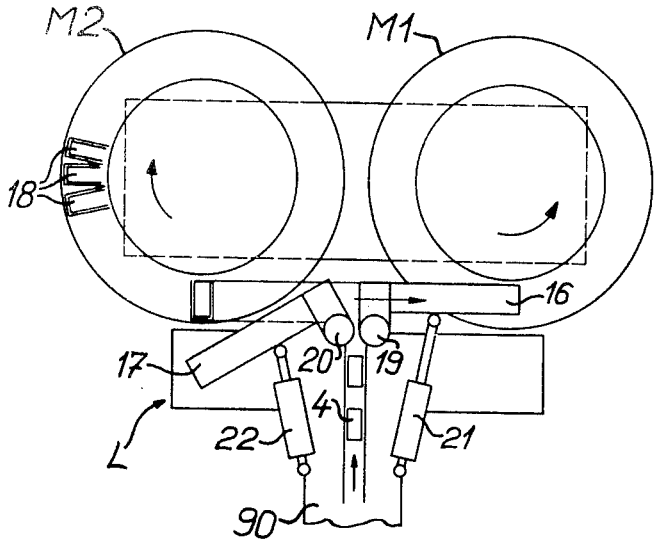
FIG. 2 is a schematic plan view of a distribution head as well as a bundle collecting device formed of two like drums.
Figure 3:
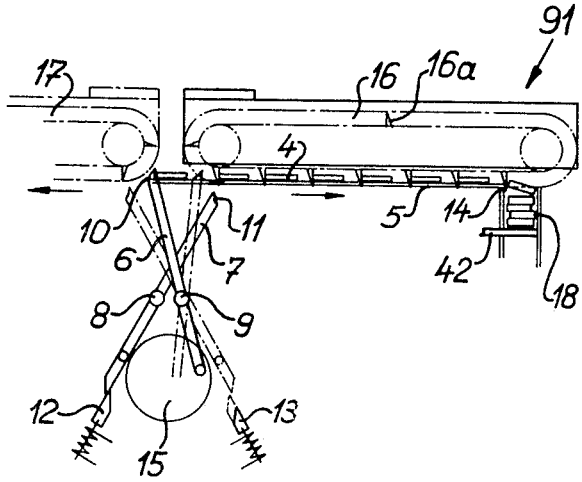
FIG. 3 is a schematic cross-section of the distribution head of FIG. 2, shown on an enlarged scale.
Figure 4:
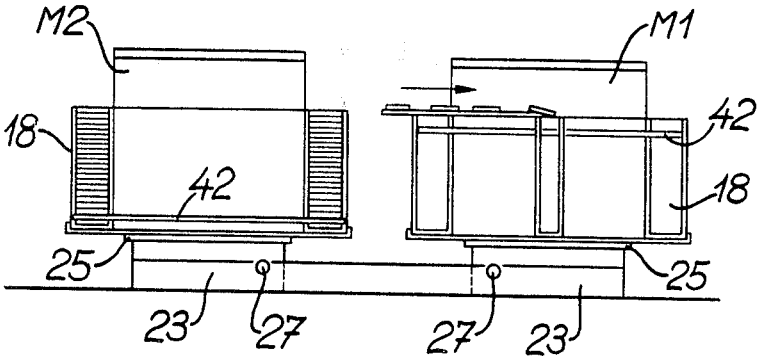
FIG. 4 is a schematic cross-section of the two drums of FIG. 2, one of these drums being empty at the beginning of a loading operation, and the other being fully loaded.
Figure 5:
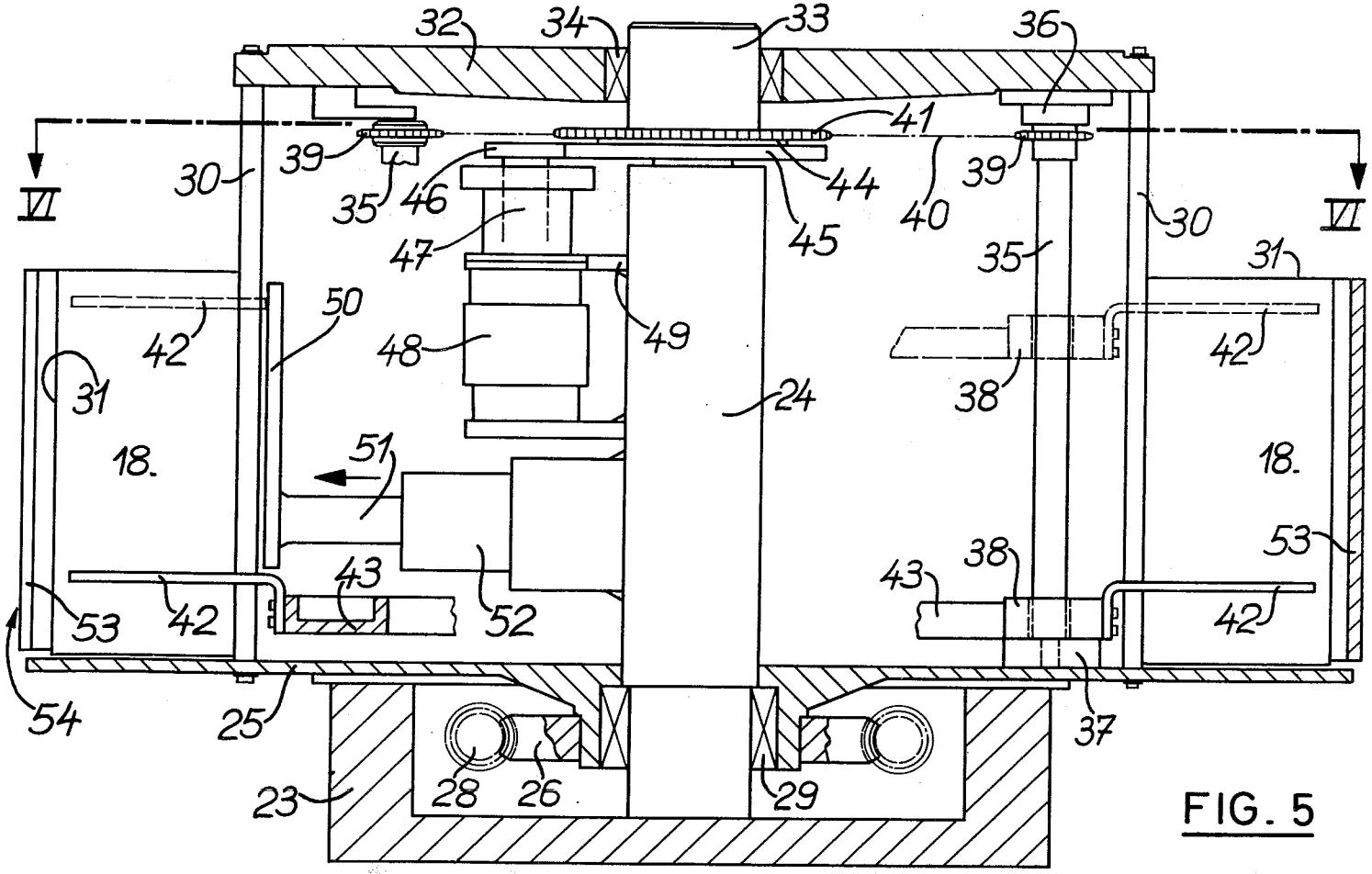
FIG. 5 is a schematic axial cross-section through one of the drums, shown on an enlarged scale.
Figure 6:
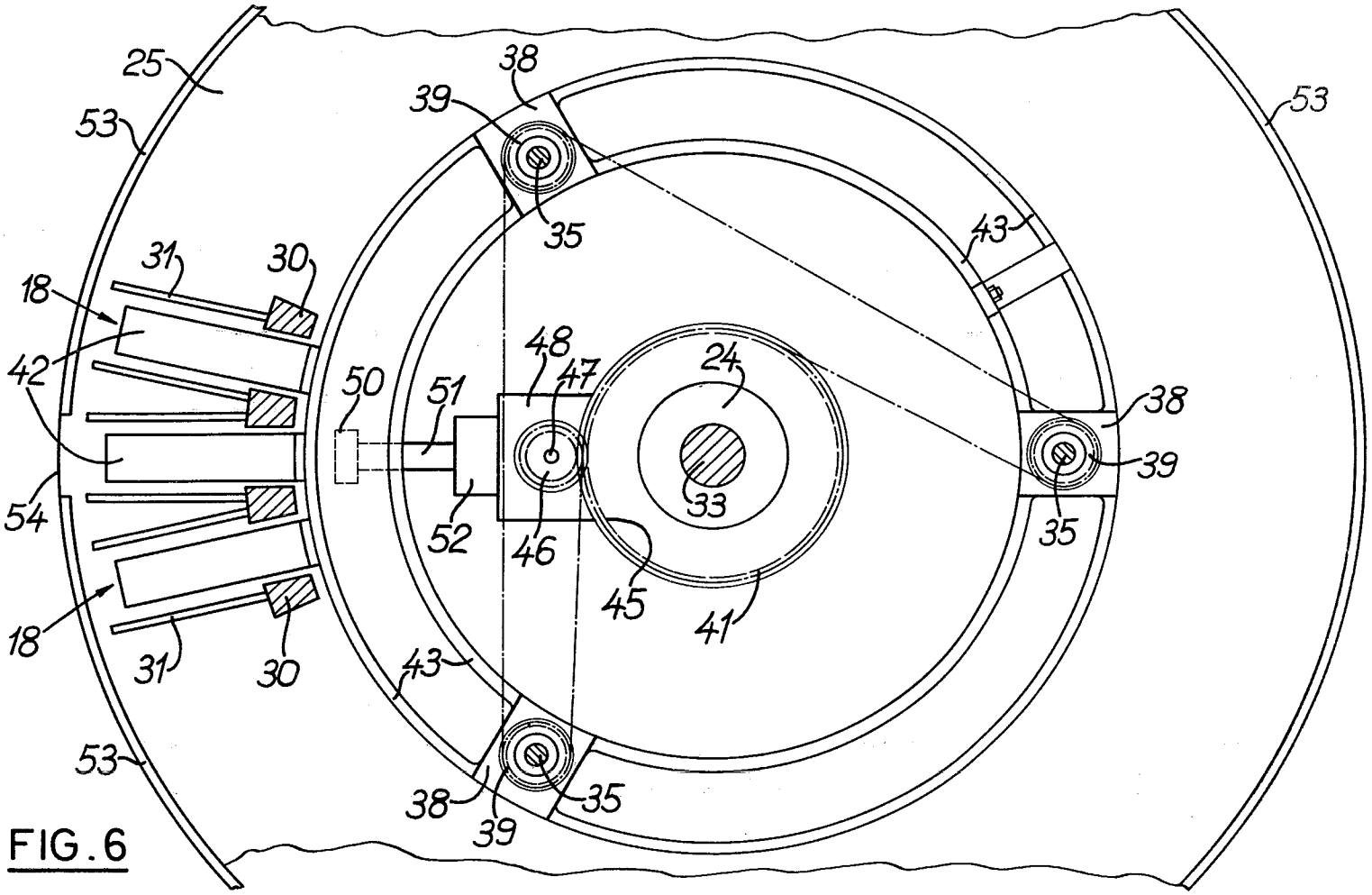
FIG. 6 is a partial plan view of a drum, in cross-section along line VI—VI of FIG. 5.

Reference is now made to FIGS. 2 and 3 showing the distribution head, and FIGS. 4 to 6 showing the bundle collecting drums M1, M2. The banded bundles 4 from conveyor path 90 arrive on a distribution table 5 (FIG. 3) disposed transverse to the previous feed direction. Under table 5 are disposed two pivoted levers 6 and 7 whose respective upper ends 10 and 11 form deviating fingers. According to whether the bundles 4 must be delivered to drum M1 or M2, a respective lever 6 or 7 is actuated by a cam 15 whereas the other lever is locked, by an electromagnetic bolt 12 or 13, in a neutral position in which the end 10 or 11 of the lever remains below the surface of table 5. In the example shown in FIG. 3, lever 6 is reciprocated by cam 15 and its end 10 pushes each bundle 4 onto table 5 and under a conveying chain 16 carrying pointed registers **16*a* which drive the bundles 4 in the direction of the arrow up to the edge 14 of the table from where they drop or slide down a slope into one of the magazines 18 of drum M1. As long as the lever 6 is actuated, i.e. unlocked, the other lever 7 is locked in its neutral position by the bolt 12 in its locking position. On the other side of the lever system and in alignment with chain 16 is a like conveyor chain 17 supplied by lever 7 to deliver the bundles to drum M2. Switching of the locks 12 and 13 is controlled by an electronic counter, not shown, each time the number of bundles 4** to completely fill one of the drums has been reached.

As shown in FIG. 2, the chains 16, 17 may advantageously be pivotally mounted about vertical axes 19, 20 whereby, under the action of compressed-air cylinders 21, 22 whose pistons are pivoted to the chain carrier, the chains can be swung away from the corresponding drums to facilitate access to the drums for maintenance and repair.

The drums M1, M2 are identical and each comprise, as shown in FIGS. 4 and 5, a base 23 supporting a central column 24 about which the drum body is rotatably guided. This drum body consists principally of a rotary dish-like base plate 25, peripheral support posts 30 extended radially outwardly by vertical walls 31 defining the individual compartments or magazines 18, and an upper plate 32. The drum body is rotatably suspended, by its upper plate 32, from an upper pivot 33 on column 24 by means of a roller bearing 34. The base plate 25 is rotatably mounted on the foot of column 24 by means of a ball bearing 29 and carries, disposed inside base 23, a toothed wheel 26 meshing with a wormscrew 28 integral with a shaft 27 (FIG. 4) driven by a motor (not shown) to rotate the drum.

The upright magazines 18 are open at their upper ends as well as on their inner and outer faces, and each comprise a mobile support plate 42 engaging between the posts 30 and walls 31 of the magazine. Plates 42 are fixed on a common ring 43 carried by three equispaced upright screws 35 engaging in corresponding threaded bores in ring 43. Screws 35 are rotatably mounted in bearings 36, 37 fixed respectively to plates 32 and 25. At their upper ends, the screws 35 have chainwheels 39 connected by an endless chain 40 passing about a central chainwheel 41. The chainwheel 41 is tightly fitted on a crown 44 rotatably mounted under roller bearing 34 by means of a ball bearing in the lower part of pivot 33; crown 44 further carries a toothed wheel 45 disposed coaxial to and under chainwheel 41. Wheel 45 meshes with a pinion 46 keyed on a shaft 47 of a motor 48 secured on the column 24 by a bracket 49. During filling of the drum, motor 48 is stopped so that chainwheel 41 and chain 40 remain at rest. Upon rotation of the drum, the chainwheels 39 roll along the stationary chain 40 so that the screws 35 turn to lower the plates 42. The transmission ratio is such that for each rotation of the drum, the plates 42 move down by a distance equal to the thickness of one bundle 4 of notes, so that the height of the fall of the bundles 4 onto the packets being formed in the magazines 18 always remains the same.

Before starting to fill a drum, the plates 42 are at the upper end-of-path position shown in dashed lines on FIG. 5, and shown for drum M1 in FIG. 4; this position is chosen so that the height of fall from the edge 14 (FIG. 3) of table 5, or from the end of the slope connected to edge 14, onto plate 42 is sufficiently small to avoid any bouncing of the bundles 4 falling into the magazines, and hence being incorrectly positioned, or jammed.

The drum peripheral speed is synchronized with the speed of conveying chains 16 and 17 so that the successively delivered bundles 4 drop into successive magazines 18. The speed of lowering of plates 42 is proportional to the number of turns of the drum, and hence is directly dependent on the operating speed of the entire installation, which can be adjusted to suit the operating conditions. The number of magazines 18 of each drum corresponds to the number of positions of the security papers, i.e. the number of serials, per sheet, namely twenty-four in the given example.

When one drum is completely filled, the plates 42 reach the lower position shown in full lines in FIG. 5, and for drum M2 in FIG. 4, and while the following bundles 4 are fed towards the other drum by means of the lever system of distribution head L, the filled drum is uncoupled from the driving shaft 27 or the driving motor is switched off, for example by means of an end-of-path switch, not shown, actuated when a plate 42 or ring 43 reaches the lower position. Successive unloading of the magazines 18 of the loaded drum then takes place by means of an axial pusher 50 disposed within the drum and fixed on piston rod 51 of a hydraulic or pneumatic jack 52 fixed on column 24.

Pusher 50 faces conveyor belt 92 (FIG. 1), and has a height corresponding to that of a packet of bundles in a magazine 18; in operation, it pushes the packet from the magazine 18 facing belt 92 onto this belt, which then delivers it towards conveyor belt 93. To discharge a fully loaded drum, the drum is rotated step-by-step by a motor, not shown, so that each successive magazine 18 stops facing belt 92 and the packet therein is removed by pusher 50. Naturally, two conveyor belts 92 are provided for the respective drums M1, M2; they are disposed on either side of an end of belt 93 and are driven in opposite directions. Once one drum has been unloaded, motor 48 is switched on; this drives, via pinion 46 and toothed wheel 45, chainwheel 41 and chain 40. The drum is stationary, and screws 35 are driven in the direction to raise ring 43 and plates 42. When ring 43 reaches the upper position, the motor 48, preferably under the control of an end-of-path switch, is stopped and braked. The drum is thus once more in its initial state ready to receive a further load of bundles from the distribution head L. Hence, each time one drum is filled, the other is emptied, the loading time being sufficient for emptying of the other drum and replacement of its ring 43 in the upper position. The openings along the inner faces of the magazines 18, defined by posts 30, are of sufficient width to allow the passage of pusher 50, but less than the width of bundles 4 which bear against posts 30. To prevent bundles from falling out of the open outer face of magazines 18, a fixed outer grid 53 is provided surrounding each drum and at least partially closing-off the open outer face of the magazines. These grids 53 have openings 54 facing conveyor belts 92 to allow the removal of packets, and further openings at the location of stations N1, N2.

The installation may, as previously mentioned with reference to FIG. 1, be independent of a principal numbering machine, in which case piles of already numbered sheets are manually delivered to the input A of the installation, or it is possible to connect the input of the cutting unit C1 to a numbering machine with a device for automatically delivering piles of printed and numbered sheets along a conveyor belt feeding them to the said input. In the latter case, the automatic processing of the sheets (inspected but not numbered) begins at the input of the numbering machine, whereby the processing is rationalized and security improved.

Figure 7:
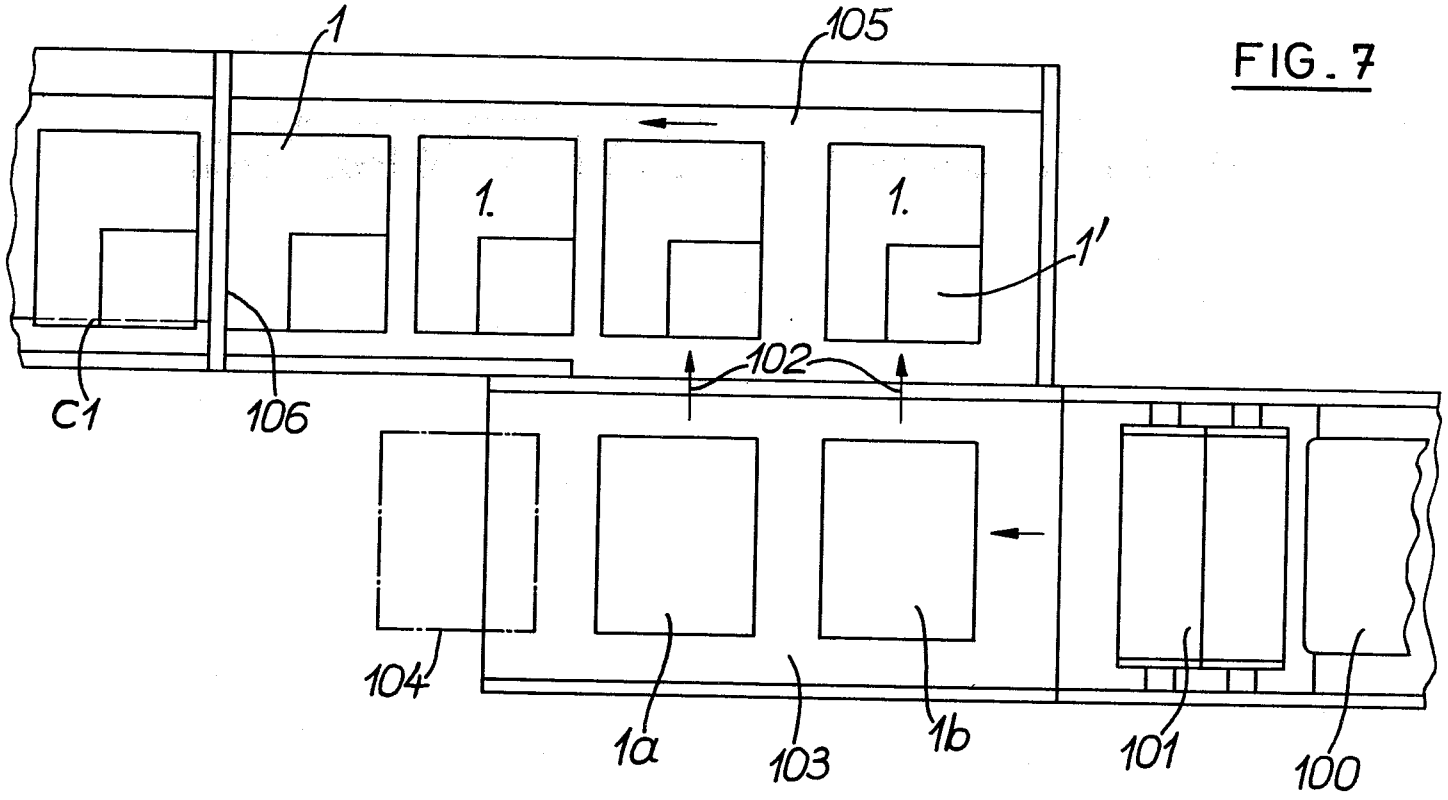
FIG. 7 schematically shows an extension to the installation by the adjunction of a sheet numbering machine.

An example of this optional extension to the installation is schematically shown in FIG. 7. The printed but un-numbered sheets of security papers, on which possible printing errors have been marked as described earlier, are delivered one-by-one by means of a conventional sheet feeder 100 to a numbering machine 101. In this numbering machine, different positions or serials of successive sheets are numbered in perfect sequence. The numbering mechanism of machine 101 advances by one step upon each revolution of a numbering cylinder, in known manner.

A known chain drive device grips the sheets at the output of machine 101 and conveys them successively as indicated by the arrow to location 1*a* where the sheets are released and fall to form a pile on table 103.

When one hundred sheets have been piled, the following hundred sheets are piled at location 1*b* downstream of location 1*a*. While a pile is being formed at 1*b*, the finished pile at 1*a* is pushed sideways by a pile shifter 102 onto a conveyor 105. Advantageously, the table 103 is lowered, at least when a pile is finished, so that the finished pile is out of the path of the chain drive device. When the following pile of sheets at location 1*b* is completed, the delivery of sheets is once more automatically switched to the cleared location 1*a*, and the pile at location 1*b* is pushed sideways onto conveyor 105 by shifter 102. The piles 1 of sheets are delivered by conveyor 105 to post 106 where they are automatically aligned and thereafter fed to the first cutting unit C1. The following operational posts of the installation correspond to those of FIG. 1.

Before the piles 1 reach the first cutting unit, an operator beside conveyor 105 may control the number printed on the uppermost sheet of the pile, since these sheets must have specific numbers.

The numbering machine 101 preferably includes conventional control devices which check the successive actuation of all of the numbering members after each revolution of the numbering cylinder. In case of a fault, a signal is delivered to place the number printing cylinder out of action before it prints with an incorrectly set number. In this manner, any numbering error is avoided, and the sheet in question moves along without being numbered and is extracted. Simultaneously, when a fault has been detected, the advance of all of the numbering members of the numbering machine is stopped during one revolution, to ensure numbering of the following sheets in perfect sequence. A numbering machine provided with such automatic number control means may, as indicated in dotted-dashed lines, have a location 104 situated in extension of table 103 and on which the unnumbered sheets, eliminated because of a fault in the numbering members, are placed. These sheets may thus be eliminated simply without it being necessary to stop the entire installation.

The described installation can be designed to process sheets of various formats; the smallest possible format is designated by 1' on FIG. 7. The installation may also be adapted for various numbers N of security papers, or "serials", in which case drums M1, M2 with the corresponding number of magazines should be used, and if necessary their speed of rotation should be adjusted.

To this end, interchangeable drums or magazines could be employed so that, according to the requirements, an appropriate number N of magazines regularly spaced about the periphery of the drum may be chosen, and the rotational speed of the drums appropriately set.

The invention, in its broadest aspect, is not limited to the described arrangement of the cutting members nor to the described arrangement of the distribution head and the magazine drums, but can englobe diverse variations thereof. Likewise, the number of bundles forming a packet may vary within large limits, as well as the number of sheets per pile i.e. the number of security papers per bundle which need not be 100, but could for example be only 50.

What is claimed is:

1. An installation for processing piles each formed of a constant number of sheets each printed with N numbered security papers such as banknotes, in which the numbering of the security papers at like positions of the successive sheets of each pile and of the successive piles is in an uninterrupted sequence, and on which sheets some of the security papers may bear control marks recording imperfections, into bundles of security papers each having said constant number of security papers in sequential order and arranged in packets of sequentially numbered bundles, in which said imperfect security papers are replaced by perfect ones, comprising:

means for receiving a pile of sheets and cutting the pile into N bundles of security papers;

means for conveying the bundles of each successively cut pile in a given order along a first path;

a detector for detecting the presence in a bundle along said first path of at least one marked imperfect security paper;

means responsive to said detector for deviating from said first path said bundles including imperfect security papers;

means for placing dummy bundles each in the place in said first path formerly occupied by a deviated bundle;

a bundle collecting device including N individual magazines for receiving respective ones of the N bundles formed from each pile of sheets, and the respective replaced dummy bundles, at the end of said first path to form N packets of a given number of bundles from a given number of piles;

means for conveying the packets of bundles from said collecting device along a second path to a packet wrapping device;

a substitution station for receiving said deviated bundles and treating them to remove imperfect security papers and replace them by perfect numbered security papers, and reform the bundles in the correct order;

and at least one bundle replacement station located before said packet wrapping device where said dummy bundles are removed from the at least partly formed packets and replaced by the respective reformed bundles delivered by said substitution station.

2. An installation according to claim 1, in which the bundle replacement station comprises magazines of said collector.

3. An installation according to claim 1, in which said substitution station includes means for automatically passing the individual security papers of a deviated bundle one-by-one past a second detector.

4. An installation according to claim 1, comprising first means on said first path before said deviating means for banding the bundles with printed bands, second means in the substitution station for banding the reformed bundles with printed bands, and third means between said bundle replacement station and said packet wrapping device for banding the packets with printed bands.

5. An installation according to claim 1, in which said packet wrapping device includes means for placing each packet in a sheet of heat shrinkable material, and a heating tunnel for shrinking said sheets onto the packets.

6. An installation according to claim 1, comprising after said packet wrapping device a serial ordinator for receiving rows of N packets with the packets of security papers cut from like positions on the sheets aligned in transverse columns.

7. An installation according to claim 2, in which said collector includes at least one rotary drum having said N individual magazines arranged at its periphery, and comprising means for driving the drum in synchronism with the delivery of bundles along said first path to receive successive bundles one-by-one in successive magazines.

8. An installation according to claim 7, in which said magazines extend vertically and each include a vertically movable support plate, and comprising means for lowering the support plates of the magazines at a rate proportional to the speed of rotation of the drum and corresponding at least approximately to the thickness of one bundle per revolution of the drum.

9. An installation according to claim 8, in which the support plates of the drum are secured on a common ring supported on vertical screws rotatably mounted on a frame of the drum, each screw carrying a chainwheel, these chainwheels being kinematically connected by an endless chain passing about a further chainwheel, and comprising means for selectively locking and driving said further chainwheel whereby, when said further chainwheel is locked and the drum rotated in its direction of operation, said screws are rotated by coaction of their chainwheels with the stationary chain in a direction to lower said ring, and when the drum is stopped said further chainwheel may be driven to raise said ring.

10. An installation according to claim 9, in which said further chainwheel is rotatably mounted on a fixed shaft and is kinematically connected to a toothed wheel meshing with a driving pinion of a motor.

11. An installation according to claim 8, comprising end-of-path switches actuated when said support plates reach extreme upper and lower positions.

12. An installation according to claim 7, comprising two like drums, and in which said first path terminates with a distribution head for alternately delivering bundles to fill one drum and then to the other drum, each drum being associated with a bundle replacement station at a given angular position of the magazines thereof.

13. An installation according to claim 12, in which said distribution head includes two conveying chains for delivering bundles to respective drums, and means for feeding bundles to a selected conveying chain.

14. An installation according to claim 12, in which each drum includes a radial pusher for removing packets of bundles from successive magazines of a filled drum facing a take-up conveyor when the drum is stopped during a step-by-step rotation thereof.

15. An installation according to claim 12, comprising a conveyor belt for conveying reformed bundles from said substitution station to towards said bundle replacement stations.

16. An installation according to claim 1, comprising a numbering machine with means for delivering numbered sheets in piles of a constant number of sheets along a given direction alternately to two locations, and means for moving a completed pile, during formation of another pile, laterally of said direction onto means for conveying the piles to said receiving and cutting means.

17. An installation according to claim 1, in which said cutting means comprises four cutting units disposed along three conveying sections disposed perpendicular to one another, namely a first cutting unit on the first conveying section for trimming a first edge of a pile of sheets parallel to the direction of feed along said first conveying section, a second cutting unit on the second conveying section for trimming a second edge of the pile of sheets opposite said first edge and cutting the pile of sheets into strips, a third cutting unit on said second conveying section for trimming a third edge of said strips parallel to the direction of feed along said second conveying section, and a fourth cutting unit on the third conveying section for trimming a fourth edge of said strips opposite said third edge and cutting said strips into bundles.

18. An installation according to claim 1, comprising, between said bundle replacement station and said package wrapping device, packet control means comprising means for detecting the presence of dummy bundles in the packets.

19. A method of processing piles each formed of a constant number of sheets each printed with N numbered security papers such as banknotes, in which the numbering of the security papers at like positions of the successive sheets of each pile and of the successive piles is in an uninterrupted sequence, and on which sheets some of the security papers may bear control marks recording imperfections, into bundles of security papers each having said constant number of security papers in sequential order and arranged in packets of sequentially numbered bundles in which said imperfect security papers are replaced by perfect ones, comprising:

cutting each pile into N bundles of security papers;

conveying the bundles of each successively cut pile in given order along a first path;

detecting the presence in a bundle along said first path of at least one marked imperfect security paper;

deviating from said first path said bundles including imperfect security papers;

placing dummy bundles each in the place in said first path formerly occupied by a deviated bundle;

individually collecting respective ones of the N bundles formed from each pile of sheets, and the respective replaced dummy bundles, at the end of said first path to form N packets of a given number of bundles from a given number of piles;

conveying the packets of bundles along a second path and wrapping the packets;

treating said deviated bundles to remove imperfect security papers and replace them by perfect numbered security papers, and reform the bundles in the correct order;

and, before wrapping the packets, removing said dummy bundles from the at least partly formed packets and replacing them by the respective reformed bundles.

20. A method according to claim 19, in which the bundles are collected and stacked by placing the bundles delivered successively to the end of the first path into successive magazines of a drum rotated in synchronization with the delivery of the bundles, and the dummy bundles are each removed from the top of a stack of bundles in a magazine and replaced at the top of the stack by the respective reformed bundle at a given angular location of the magazine.

* * * * *